United States Patent [19]

Sheahan et al.

[11] 4,045,934

[45] Sept. 6, 1977

[54] ROOF AND METHOD OF PREPARATION

[75] Inventors: James P. Sheahan; Lowell E. Putnam, both of Worthington, Ohio

[73] Assignee: The Dow Chemical Company, Midland, Mich.

[21] Appl. No.: 673,334

[22] Filed: Apr. 2, 1976

Related U.S. Application Data

[63] Continuation of Ser. No. 567,454, April 11, 1975, abandoned.

[51] Int. Cl.[2] ..... E04B 7/00; E04B 1/66

[52] U.S. Cl. ..... 52/514; 52/309.4; 52/408; 156/71

[58] Field of Search ..... 52/309, 408, 514; 156/71

[56] References Cited

U.S. PATENT DOCUMENTS

| | | | |
|---|---|---|---|
| 3,345,246 | 10/1967 | Sheahan | 52/514 X |
| 3,411,256 | 11/1968 | Best | 52/309 X |
| 3,763,605 | 10/1973 | Freeman | 52/302 X |
| 3,763,614 | 10/1973 | Hyde et al. | 52/309 |

*Primary Examiner*—J. Karl Bell

*Attorney, Agent, or Firm*—R. B. Ingraham

[57] ABSTRACT

Ponding is eliminated or substantially reduced on flat roofs by employing a closed cell, thermally insulating foam above the water barrier layer and varying the thickness of the closed cell foam to displace at least a majority of water which might accumulate in areas subject to ponding.

9 Claims, 2 Drawing Figures

ROOF AND METHOD OF PREPARATION

Figure 1:
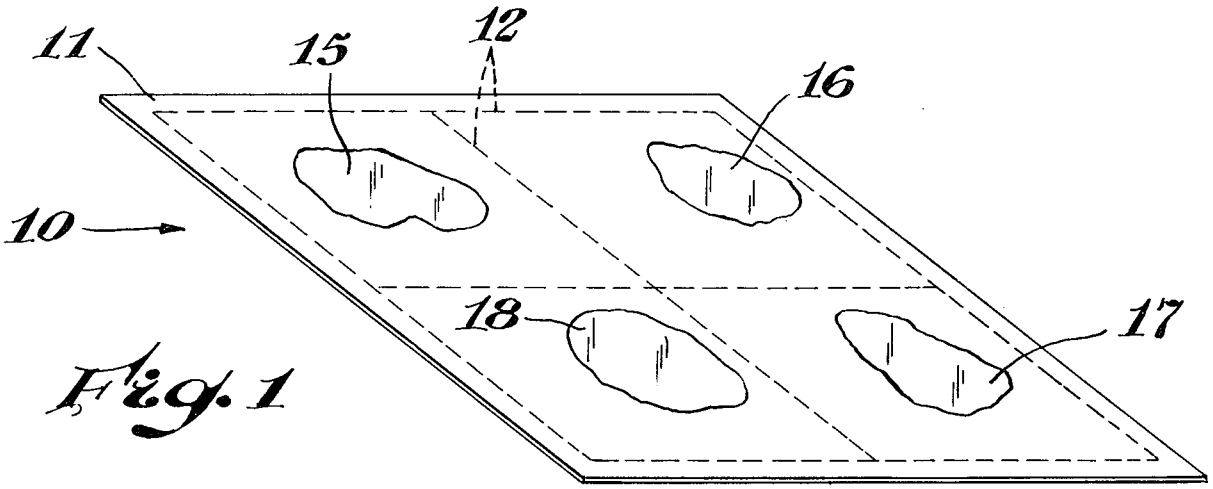

This is a continuation, of application Ser. No. 567,454 Filed April 11, 1975 now abandoned.

In the construction of new buildings, flat roofs are frequently employed. Flat roofs have an inherent economic advantage in that they can be installed at a relatively low cost with minimal labor. Generally flat roofs are supported by appropriate rafters or like framework assembly. A roof deck is applied over the frame or rafters and a suitable water impermeable membrane is disposed above the roof deck. Oftentimes a thermal insulation layer is incorporated into a flat roof structure. A particularly preferred variety of such a flat roof structure is set forth in U.S. Letters Pat. Nos. 3,411,256 and 3,763,614. In general such structures employ a roof deck which has a water barrier layer disposed thereon and generally adjacent thereto, a layer of closed cell plastic foam thermal insulation with an ultra violet protective layer disposed above the foam layer. In other flat roof varieties, the thermal insulation may be disposed below the roof deck or beneath the water barrier layer. In general, in the preparation of flat roofs, they are designed to withstand the appropriate snow and wind loadings with a reasonable deflection. Oftentimes such roofs have portions which are generally disposed within the perimeter of the roof and have a lower elevation than the perimeter. Such lower elevations may be caused by deflection of the roof deck within the supporting framework, by deflection or deterioration of the framework itself or by settling of portions of the building as the years pass. Usually the water barrier membrane employed is a laminated structure having a plurality of layers of roofing felt bonded to each other by means of bituminous composition. Roofs having such a barrier are often known as built-up roofs. Other roofs of the flat variety may employ as the water impermeable membrane a plastic sheet which may be partially prefabricated and installed in sections on the roof and the sections adhered together to form a continuous water impermeable membrane. Alternatively the membrane may be formed on the roof itself by the use of appropriate reactive chemicals such as those employed to form cast or sprayed in place polyurethane structures. Generally, regardless of type of flat roof that is employed, ponding frequently occurs. Oftentimes the occurrence of ponding requires, for optimum performance of the roof, the installation of drains to remove standing water from the pond areas or alternatively movement of the roof such as by providing additional bracing and support for the roof and raising the area subject to ponding so that water may drain over the roof edge under the influence of gravity. Generally the elimination of ponding on new construction or on reroofing is expensive and time consuming.

It would be desirable if there were available an improved flat roof structure which would reduce ponding.

It would also be desirable if there were available an improved roof structure which would reduce ponding with minimal additional labor and expense.

It would also be desirable if there were an improved method for roofing and/or reroofing which would eliminate or minimize ponding with minimal expense.

These benefits and other advantages in accordance with the present invention are achieved in a roof structure, the roof structure comprising in cooperative combination a roof support means, the roof support means carrying thereon a roof deck, the roof deck supporting a water impermeable membrane, the water impermeable membrane having a generally flat surface generally coextensive with the roof and deck, a first layer of closed cell plastic foam insulation adjacent the membrance and remote from the deck, the membrane and first layer defining at least one generally upwardly facing cavity in which water does not drain under the influence of the force of gravity, the improvement which comprises at least one second layer of a closed cell plastic foam disposed within the cavity, the plastic foam of the second layer being present in a quantity sufficient to displace at least a major portion of water which would collect in the cavity under the influence of the force of gravity.

Also contemplated within the scope of the present invention is a method for roofing and reroofing, the steps of the method comprising; providing an upwardly facing roof surface having a first layer of closed cell plastic foam insulation thereon, the roof surface being subject to ponding, that is the collection of water in upwardly facing cavities of the roof surface under the influence of gravity, the cavities being so arranged that water collected therein is not displaced therefrom by the force of gravity, the improvement which comprises disposing within the cavity a second layer of closed cell plastic foam sufficient to displace at least a major portion of water which would otherwise collect in said cavities.

Further features and advantages of the present invention will become more apparent from the following specification taken in connection with the drawing wherein:

FIG. 1 schematically depicts a roof structure subject to ponding.

Figure 2:
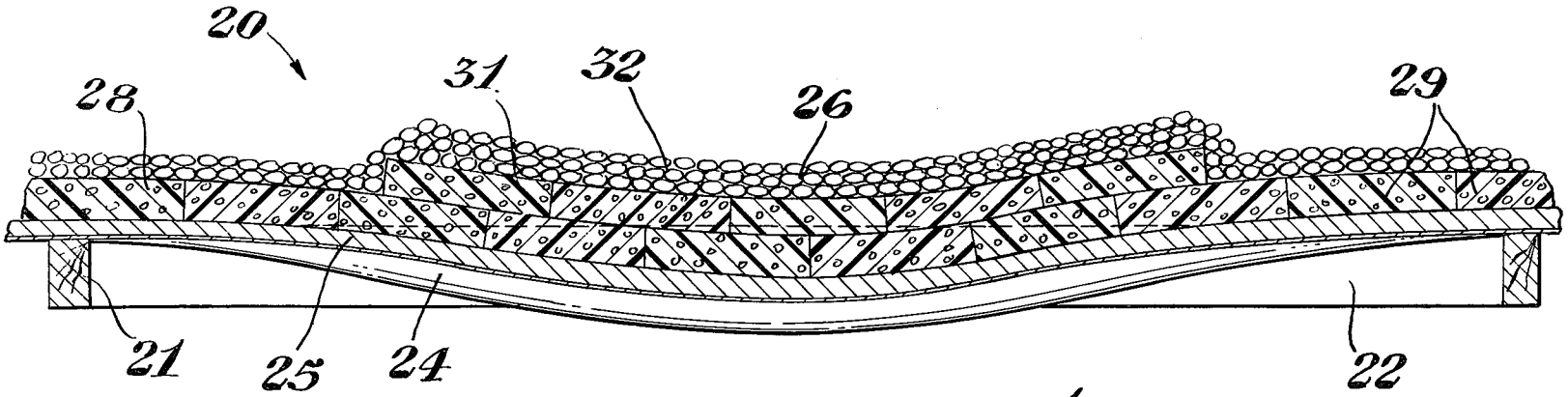

FIG. 2 is a sectional fragmentary representation of a roof in accordance with the present invention.

In FIG. 1 there is schematically illustrated a sectional view of flat roof which is subject to ponding generally designated by the reference number 10. The roof 10 comprises in cooperative combination a planar roof structure 11. The details of the structure of the member 11 are not shown. The roof member 11 is supported by means of framework 12 disposed beneath the roof member 11. The roof 10 defines a plurality of upwardly facing cavities 15, 16, 17 and 18. The cavities 15, 16, 17 and 18 are generally disposed centrally within openings defined in the framework 12 and result from the deflection of the roof member 11 cavities 15, 16, 17 and 18 are areas of the roof which are subject to ponding, that is locations where water will pool and cannot drain therefrom under the influence of gravity. Such areas of ponding are generally considered to be undesirable in a roof structure. Oftentimes they contribute to undesirable structural loads and provide a region for growth of bacteria, fungi and other undesirable organisms which Often contribute to failure of the roof membrane and occassionally to reduced efficiency of thermal insulation which may be disposed on the roof membrane.

In FIG. 2 there is depicted a schematic fractional cross-sectional representation of a roof in accordance with the present invention generally designated by the reference numeral 20. The roof 20 comprises in cooperative combination a frame or framework 21 which is generally horizontally disposed and defines therein at least one opening 22. A roof deck 24 is supported on an upperside of the framework at 21. The roof deck 24 has disposed thereon a water impermeable layer or membrane at 25. The membrane at 25 is generally coextensive with the deck at 24. As depicted in FIG. 2, the deck 24 and membrane 25 are deflected into the cavity 22 of the frame at 21. The membrane 25 defines a generally upwardly facing cavity 26, the uppermost level thereof being indicated by the dotted line which passes through the termination of the lead line 26. A layer 28 of the thermal insulation is disposed adjacent membrane at 25 and remote from the frame 21. The layer 28 comprises a plurality of individual rectangular blocks or planks 29 of a closed cell synthetic resinous plastic foam thermal insulation. The elements 29 which make up the foam insulation layer are disposed in close proximity to each other; however, no effort is made to provide a water impermeable seal between adjacent members 29. A second layer 31 of insulating material similar to the material of insulating layer 28 is disposed over the layer 28 in the region of the cavity 26. The combined thickness of the layers 28 and 31 is in excess of the depth of the pond which could form in the absence of the layers 28 and 31. A ballast layer 32 is disposed of the uppermost exposed portions of layers 28 and 31. Beneficially the ballast layer provides two functions: (1) It protects the closed cell plastic insulating layer from ultraviolet light and (2) it provides sufficient mass to prevent flotation of the insulation layer in the presence of water which may be disposed on the roof in the form of rain or from melting snow. The ballast layer should also be of sufficient mass to prevent movement of any of the components of layers 28 or 31 under the influence of wind.

A wide variety of materials may be employed for the ballast layer including thin concrete or mortar slabs, tiles, pebbles and the like. Generally for most installations, gravel which varies in average diameter from about ¾ of an inch to about 1θ inches is most desirable.

The basic details of construction of such built-up roofs are set forth in U.S. Pat. Nos. 3,411,256 and 3,763,614 the teachings of which are herewith incorporated by reference thereto. In preparing the roofing in accordance with the present invention, ponding which arises in older roofs are often readily identified by observation of the roof during or shortly after rainstorms. The maximum depth of the pond can readily be determined with simple measurements and the periphery readily determined. Alternatively, if it is necessary to determine the ponding areas in dry weather, oftentimes the roof may be flooded with water from a convenient hose. If the periphery of the dry pond is known, the depth can generally be readily determined with the aid of a rule and a chalk line. If serious ponding problems exist and the extent of the ponding areas need to be determined rapidly, the contours of the roof are readily mapped with conventional surveying equipment such as a rod and slighting level.

Generally in applying the appropriate amount of foam insulation to a ponding area, one does not attempt to prepare a roof with a totally flat upper surface. Usually foam plastic insulation is available in a variety of thicknesses and for most roofing projects it is convenient to use 2 inch thick foam planks. Such planks are deposited over the area subject to ponding until the appropriate thickness has been obtained and an appropriate ballast layer placed over the foam. Generally in areas subject to ponding, it is desirable to increase the thickness of the ballast layer enough to compensate for the flotation effect of water about the foam under conditions of steady rain which otherwise would result in ponding. If desired, the thickness of the foam may be varied in such a manner that no more than the required thickness of foam is applied to the ponding area; however, for most roofing installations the added effort and expense of cutting the foam to varying predetermined thicknesses is usually not economically warranted. Although the improvement of FIG. 2 has been described with reference to what is frequently referred to as an inverted roof membrane assembly, that is an assembly wherein the thermal insulation is disposed above the water barrier membrane of the present invention which is readily applied to conventional roofing which employs the water impermeable membrane, is immediately adjacent the uppermost gravel layer.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A roof structure, the roof structure comprising in cooperative combination a roof support means, the roof support means carrying theron a roof deck, the roof deck supporting a water impermeable membrane, the water impermeable membrane having a generally flat surface generally coextensive with the roof and deck, a first layer of closed cell plastic foam insulation adjacent the membrane and remote from the deck, the membrane and first layer defining at least one generally upwardly facing cavity in which water does not drain under the influence of the force of gravity, the improvement which comprises at least one second layer of a closed cell plastic foam disposed within the cavity, the plastic foam of the second layer being present in a quantity sufficient to displace at least a major portion of water which would collect in the cavity under the influence of the force of gravity.

2. The roof of claim 1 wherein the first layer comprises a plurality of generally rectangular planks.

3. The roof of claim 2 wherein the second layer comprises a pluraity of generally rectangular planks.

4. The roof of claim 3 including a layer of particulate inorganic material disposed over the plastic foam of the first and second layers.

5. The roof of claim 4 wherein the particulate inorganic material is gravel.

6. A method for roofing and reroofing, the steps of the method comprising;

providing an upwardly facing roof surface having a first layer of closed cell plastic foam insulation thereon, the roof surface being subject to ponding, that is the collection of water in at least one upwardly facing cavity of the roof surface under the influence of gravity, the cavity being so arranged that water collected therein is not displaced therefrom by the force of gravity, the improvement which comprises disposing within the cavity a second layer of closed cell plastic foam sufficient to displace at least a major portion of water which would otherwise collect in said cavity.

7. The method of claim 6 wherein the first and second layers comprise generally rectangular planks.

8. The method of claim 7 including the steps of disposing a layer of particulate inorganic material over the first and second layers.

9. The method of claim 8 wherein the particulate inorganic material is gravel.

* * * * *

UNITED STATES PATENT AND TRADEMARK OFFICE

CERTIFICATE OF CORRECTION

PATENT NO. : 4,045,934

DATED : September 6, 1977

INVENTOR(S) : James P. Sheahan, Lowell E. Putnam

It is certified that error appears in the above-identified patent and that said Letters Patent are hereby corrected as shown below:

Column 1, after the title line, insert --Cross-Reference to Related Application--.

Column 2, line 6, delete "brance" and insert --brane--.

Column 2, line 49, delete "cavities" and insert --Cavities--.

Column 2, line 57, delete "Often" and insert --often--.

Column 2, line 58, delete "occassionally" and insert --occasionally--.

Column 3, line 36, delete "10" and insert -- 1 1/4--.

Column 4, line 50, delete "pluraity" and insert --plurality--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*